US005140980A

United States Patent [19]

Haughey et al.

[11] Patent Number: 5,140,980

[45] Date of Patent: Aug. 25, 1992

[54] HOOD MASK AND AIR FILTER SYSTEM AND METHOD OF MANUFACTURE THEREOF

[75] Inventors: John R. Haughey; Lisa H. Jackson, both of Dover, Del.

[73] Assignee: ILC Dover, Inc., Frederica, Del.

[21] Appl. No.: 538,036

[22] Filed: Jun. 13, 1990

[51] Int. Cl.[5] ..... A62B 7/10; A62B 19/00; A62B 23/02; A62B 18/02

[52] U.S. Cl. ..... 128/201.25; 128/206.19; 128/206.17

[58] Field of Search ..... 128/201.17, 201.25, 128/206.12, 206.16, 206.17, 206.19, 205.27, 205.28, 205.29

[56] References Cited

U.S. PATENT DOCUMENTS

| | | | |
|---|---|---|---|
| 145,874 | 12/1873 | James | 128/205.29 |
| 1,963,874 | 6/1934 | Stampe | 183/45 |
| 2,724,457 | 11/1955 | Besser | 183/69 |
| 2,898,908 | 8/1959 | Sovinsky | 128/206.17 |
| 2,910,979 | 11/1959 | Shanty et al. | 128/206.12 |
| 3,118,445 | 1/1964 | Norman | 128/206.17 |
| 3,695,265 | 10/1972 | Brevik | 128/858 |
| 3,731,678 | 5/1973 | Pyzel | 128/205.27 |
| 4,011,067 | 3/1977 | Carey, Jr. | 128/205.29 |
| 4,064,876 | 12/1977 | Mulchi | 128/206.15 |
| 4,215,682 | 8/1980 | Kubik et al. | 128/206.19 |
| 4,231,118 | 11/1980 | Nakagawa | 128/201.25 |
| 4,294,599 | 10/1981 | Grovesteen et al. | 55/485 |
| 4,366,054 | 12/1982 | Kronsbein | 210/266 |
| 4,382,440 | 5/1983 | Kapp et al. | 128/201.25 |
| 4,444,575 | 4/1984 | Miller et al. | 55/316 |
| 4,628,927 | 12/1986 | Ward | 128/206.17 |
| 4,643,182 | 2/1987 | Klein | 128/206.19 |
| 4,683,880 | 8/1987 | Werjefelt | 128/201.28 |
| 4,754,751 | 7/1988 | Mausteller et al. | 128/205.28 |
| 4,886,058 | 12/1989 | Brostrom et al. | 128/206.12 |
| 4,886,527 | 12/1989 | Fottinger et al. | 55/156 |
| 4,900,346 | 3/1989 | Lutz | 55/387 |

OTHER PUBLICATIONS

Hawley's Condensed Chemical Dictionary, 11th ed., Sax & Lewis, Sr.-ed., Van Nostrand Reinhold Co., N.Y., ©1987, p. 1083.

*Primary Examiner*—Edgar S. Burr
*Assistant Examiner*—Kimberly L. Asher
*Attorney, Agent, or Firm*—Stevens, Davis, Miller & Mosher

[57] ABSTRACT

The present invention is directed to a hood mask for protecting the wearer from chemical and biological environmental contaminants. The hood mask includes a hood having a substantially tubular portion which includes a closed upper end, an open lower end and a continuous side wall having inner and outer surfaces. An air filter assembly is connected to the tubular portion to purify air breathed into the interior of the hood by the wearer. The filter assembly includes a first layer formed of a first member and a second layer including a holder which supports a rigid shell member which houses a second filter member. The holder is formed of a flexible material which as a throughbore in which the shell member is disposed. The first layer and the holder are sealed to one another at their outer edges. The hood mask can be assembled by positioning the first layer and the second layer of the filter assembly adjacent one another and adjacent the tubular portion of the hood mask such that the first layer is interposed between the second layer and the tubular portion, and sealing the first layer and the second layer at their outer edges to the tubular portion by a heat sealing process. A separator member is disposed between the first layer and the second layer in a floating or a non-secured condition relative to the tubular portion of the hood mask.

40 Claims, 4 Drawing Sheets

HOOD MASK AND AIR FILTER SYSTEM AND METHOD OF MANUFACTURE THEREOF

FIELD OF THE INVENTION

The present invention relates to a protective hood mask and particularly, a hood mask including an integrated air filter connected to the hood material. The invention also relates to a method of manufacturing such a hood mask and filter.

BACKGROUND OF THE INVENTION

It is well known that an increasing number of nations throughout the world possess, or are attempting to develop, chemical-biological (CB) agents and delivery systems capable of striking military and civilian targets with little or no warning. Presently, due primarily to factors of cost and bulk, no suitable protective hood mask exists which is satisfactorily designed for widespread, but short duration, use only. Heretofore, hood masks have been too expensive to be truly disposable (i.e., one-use only) or available for widespread use or too large and heavy to enable convenient personal stowage and transport by individuals.

To minimize the effects of CB attacks, a need exists for a reliable, low cost, small-sized, light-weight, foldable and disposable protective hood mask for use by military and civilian populations in emergency situations in contaminated environments. Such a hood mask need only provide the user with protection for a short time period (e.g. two hours); within that period, the user will locate a permanent mission mask and transition into it, process into a collective protective shelter or move to an uncontaminated location. A need for a hood mask exists, which has a small stowage volume to be able to fit into a G-suit and individual protective equipment (IPE) pockets. Needs for such a hood mask include temporary use by military personnel to enable them to get to a duty station during a CB attack or when they are in transit due to temporary duty or reassignment; civilians to escape exposure to toxic chemical spills; civil reserve air fleet (CRAF) aircraft crews deploying to high threat areas; covert military operations; military reservists; military dependents; military medical operating room personnel and military medical corp in hospital and field sites; and medical patients in some circumstances. Such masks are also needed as an emergency mask in CB collective protective shelters in the event shelter filtration system fails or emergency evacuation of the shelter is required when contamination is present.

Despite the above-noted critical needs, no satisfactory low-cost, small, light-weight, foldable and disposable hood mask has heretofore been provided.

A significant bar to achieving a hood mask assembly with the above features has been the need for a suitable respiratory filter which is attached to the hood material. Prior art hood mask designs include filters housed in large, bulky, hard and rigid canisters which are incapable of being folded and result in an overall bulky hood mask requiring a large stowage volume. Examples of such prior art designs are disclosed in U.S. Pat. Nos. 1,963,874 and 4,294,599, the disclosures of both of which are incorporated by reference herein.

SUMMARY OF THE INVENTION

The present invention intends to overcome all of the above-noted problems associated with prior art hood mask and filter designs. The object of the present invention is, inter alia, to provide an improved hood mask which is reliable, inexpensive and therefore conducive to widespread use, small-sized to yield a small stowage space, lightweight, foldable and disposable. The present invention also intends to provide an improved air purifying filter which is flexible to enable folding in order to minimize stowage space, which dispenses with the necessity of heretofore used rigid canisters for housing the filter and which is miniaturized to provide a low profile and hence low bulk or volume. The filter according to the invention dispenses with the need for mechanical attachments to a system, such as a hood mask, with which it is integrated. The invention further provides a filter which can be integrated to a system via heat sealing, sewing, or adhesive bonding, and which may be integrated with various types of material, such as cloth and plastic sheeting.

Accordingly, the present invention provides a hood mask for protecting the wearer from chemical and biological environmental contaminants, which comprises a hood including a substantially tubular portion having a closed upper end, an open lower end, a continuous side wall having inner and outer surfaces, and a sealing means attached to the tubular portion near the lower end of the tubular portion to provide an air tight closure around the neck of the wearer; and an air filter means connected to the tubular portion for purifying air breathed into the interior of the hood by the wearer. The filter means includes (a) a first layer formed of a first filter member; and (b) a second layer including a holder which supports a rigid member which houses a second filter member. The holder is formed of a flexible foldable material which has a throughbore in which the rigid member is disposed. The first layer and the holder are sealed to one another at their outer edges. The first layer and the holder are sealed at their outer edges to the tubular portion.

The filter means can further comprise a third layer comprising a separator member which has outer dimensions slightly smaller than those of the first layer and the holder and is interposed in a floating condition relative to the tubular portion between the first layer and the second layer.

The filter means can further comprise another layer comprising a screen member, with the first layer being interposed between the screen member layer and the second layer and the screen member layer being sealed at its outer edges to the first layer, the holder, and the tubular portion. The filter means can also include a flange member disposed such that the screen member is interposed between it and the first layer. The flange member overlaps the screen member and is sealed to the inside surface of the tubular portion.

The screen member can comprise a synthetic fiber screen structure. The rigid member can be formed of sheet metal such as aluminum or may be formed of hard plastic.

The first filter member can be an aerosol filter media and the second filter member can be a gas adsorbing and scrubbing media. The aerosol filter media can comprise a synthetic microfiber material. Also, the aerosol filter media can be permanently electrostatically charged. The holder can be made of a polymeric material. The first layer, the holder and the third layer can be heat sealed at their outer edges to said tubular portion.

Also according to the invention, there is provided an air filter assembly, which includes a first layer formed of a first filter member; and a second layer including a holder which supports a rigid member which houses a second filter member. The holder is formed of a flexible foldable material which has a throughbore in which the rigid member is disposed. The first layer and the holder are sealed to one another at their outer edges. In one embodiment, the first layer and the holder are heat sealed to one another at said outer edges. The filter means can further comprise a third layer comprising a separator member which has outer dimensions slightly smaller than those of the first layer and the holder and is interposed in a floating condition relative to the tubular portion between the first layer and the second layer.

The filter means can further comprise another layer comprising a screen member, with the first layer being interposed between the screen member layer and the second layer and the screen member layer being sealed at its outer edges to the first layer, the holder, and the tubular portion.

The invention also provides a method of manufacturing a hood mask comprising a hood including a substantially tubular portion having a closed upper end, an open lower end and a continuous side wall having inner and outer surfaces, and an air filter means connected to the tubular portion for purifying air breathed into the interior of the hood by the wearer, wherein the filter means comprises a first layer formed of a first filter member and a second layer including a rigid shell member which houses a second filter member, with the holder being formed of a flexible foldable material which has a throughbore in which the rigid member is disposed. The method of the invention includes the steps of: (a) positioning the first and second layers adjacent to one another and adjacent to the tubular portion such that the first layer is interposed between the second layer and the tubular portion; and (b) heat sealing the first and second layers at their outer edges to the tubular portion. The method can further comprise positioning a third layer comprising a separator member which has outer dimensions slightly smaller than those of the first layer and the holder between the first and second layers prior to step (b) and wherein step (b) comprises sealing the first layer and the second layer at their outer edges to the tubular portion with the third layer interposed between them in a floating condition relative to the tubular portion.

BRIEF DESCRIPTION OF THE DRAWINGS

The above and other objects, advantages and features of the present invention will be more fully understood when considered in conjunction with the attached figures, of which.

DETAILED DESCRIPTION OF THE PREFERRED EMBODIMENTS

Figure 1:
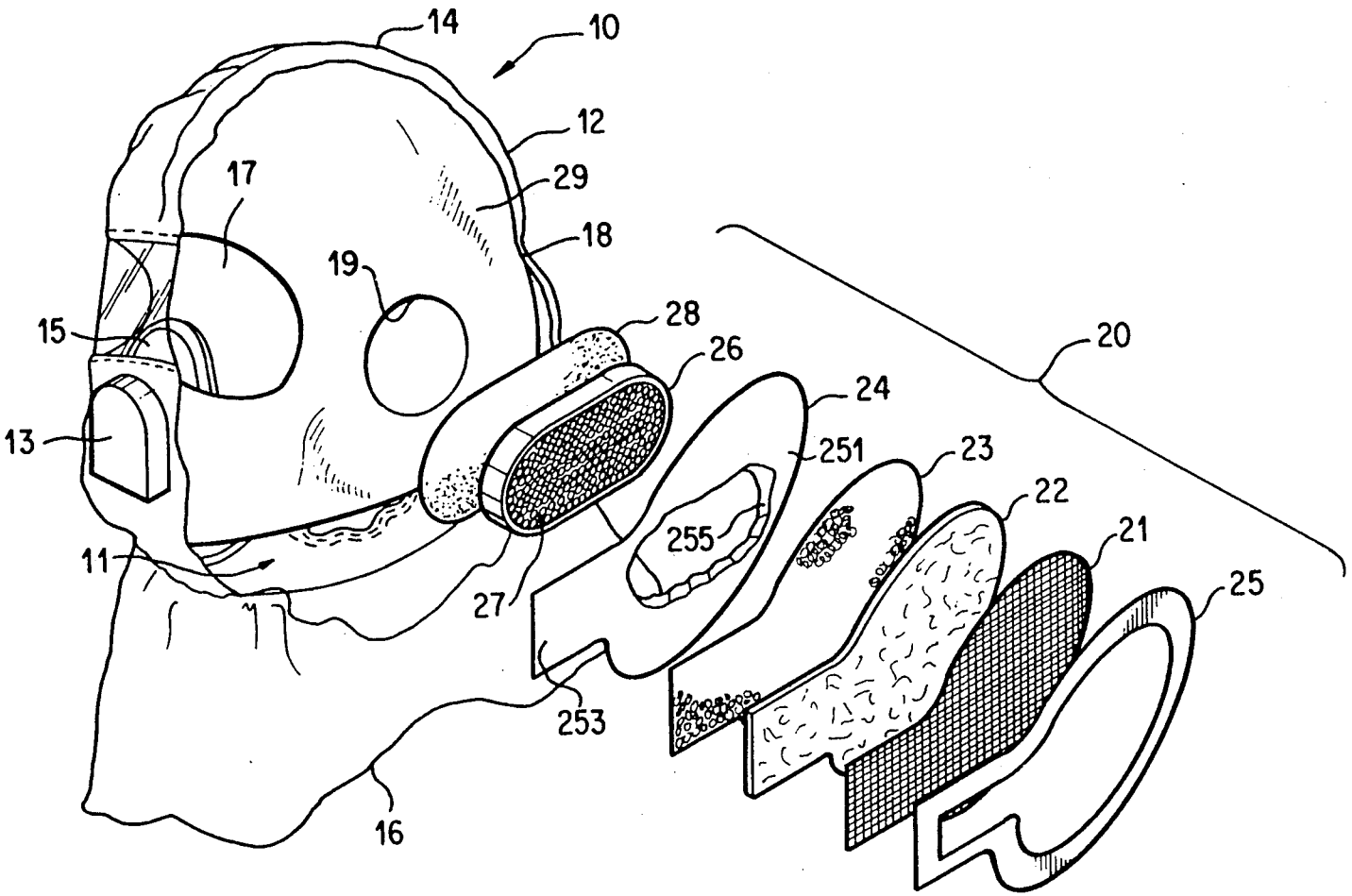
FIG. 1 is an exploded view of the hood mask of the invention.

FIG. 1 shows an embodiment of a hood mask 10 according to the invention, which includes a tubular portion having a closed upper end 14, an open lower end 16 and a downwardly extending side wall 18. Tubular portion 10 may be fabricated from an impermeable vinyl/PVC laminate or other suitable hood mask materials known in the art. A sealing means 11 is attached to tubular portion 12 at lower end 16 to provide an airtight closure around the neck of a wearer. Sealing means 11 may be a substantially annular, resilient neck seal of elastomeric material or a thin urethane film. Other suitable materials known in the art which provide a resilient neck seal may also be used. Tubular portion 12 includes a full head encapsulating retention mechanism 29 provided by providing tubular portion 12 with a section composed of spandex material. In the illustrated embodiment, hood mask 10 also includes an exhaust valve 13, a conformal elastomeric nosecup 15 and a transparent visor 17 formed of a clear flexible vinyl material.

The combination of the resilient neck seal, full head encapsulating spandex retention mechanism and conformal silastic nosecup provides a "one size fits all" hood mask which requires no secondary adjustments once donned.

Tubular portion 10 includes an opening 19 in side wall 18. A filter assembly 20 is attached to the inside surface of side wall 18 adjacent opening 19 to provide air communication between the inside of the hood mask and the outside environment.

Filter assembly 20 has a laminated or sandwiched configuration including a flange member 25, a screen 21, an aerosol filter media layer 22, a perforated or porous separator 23, a formed holder 24 and a rigid shell 26 which holds a gas adsorbing or scrubbing material 27 such as activated charcoal. Shell 26 may be formed of stamped, drawn or otherwise formed sheet metal such as aluminum or alternatively, may be formed of hard plastic. Shell 26 fits relatively tightly into an opening 255 in holder 24 such that holder 24 securely supports shell 26. Shell 26 and holder 24 together with the gas-adsorbing or scrubbing material 27 constitute one layer of the laminated filter assembly. Separator 23 is interposed between aerosol filter media 22 and the layer comprising holder 24, shell 26 and gas-adsorbing or scrubbing material 27 to prevent the aerosol filter media 22 from collapsing on the entrance to gas-adsorbing or scrubbing filter media 27 within shell 26. Screen 21 may be formed of, e.g., a synthetic fiber screen structure and functions to prevent accidental puncture of aerosol filter media 22. Separator 23 may be formed of any suitable porous or perforated spacer material having low breathing resistance.

Formed holder 24 is made of a polymeric material, although other suitable flexible-foldable heat-sealable materials may also be employed. An oblong annular planar member 28 formed of felt or other cushioning material is attached to the back side of shell 26 for abutment against the head of the wearer. During use, air flows from the ambient through screen 21, filter media 22, separator-spacer 23, opening 25, filter media 27, the central opening in oblong annular member 28 and into the interior of hood mask 10. It should be noted that annular member 28 can be formed of any material suitable for comfortable abutment against the head of the user.

Aerosol filter media 22 may be formed of a synthetic microfiber and may be permanently electrostatically charged to aid in capture of particulate matter contaminants. The electrostatic charging may be accomplished in accordance with known techniques; see, e.g.. U.S. Pat. Nos. 2,724,457, 4,886,527 and 4,900,346, the disclosures of each of which are incorporated by reference herein. It should be noted that media 22 may also be formed of other aerosol filter materials, such as closely spiralled fiberglass.

As is apparent from FIG. 1, filter assembly 20 is attached to tubular portion 12 such that the flat front surface of flange member 25 abuts against the inside surface of sidewall 18 of tubular portion 12. Holder 24 has an oblong annular planar main body portion 251 and a flap portion 253 extending from annular main body portion 251. As illustrated in the drawings, flange member 25, screen 21, filter layer 22 and separator 23 each have a shape similar to that of holder 24; i.e., they each have a main body portion and a flap portion. However, it should be noted that the above elements could have other alternative shapes enabling them to be sealed to one another and to tubular portion 12 in the manner described herein. It should also be noted that flange member 25 preferably has an outer periphery which extends beyond the outer periphery of screen member 21 and filter media 22 so that the back surface of flange member 25 directly abuts against the outer periphery of formed holder 24 and is sealed directly thereto to provide effective sealing of the layers forming the overall filter assembly 20. At its front surface flange member 25 abuts against the inside surface of sidewall 18 of tubular portion 12, so that filter assembly 20 is attached to the inside surface of tubular portion 12 via the abutting front surface of flange member 25. The attachment of filter assembly 20 to tubular portion 12 is preferably accomplished by a heat sealing process, although the filter assembly according to the invention can be integrated with various types of materials, such as cloth and plastic sheeting. The attachment of the filter assembly may be carried out by sewing, adhesive bonding or heat sealing, in a manner suitable to the type of material to which it is to be sealed. While the filter assembly of the invention is described herein particularly in an embodiment for use with a hood mask, it should be noted that it may be employed in other devices or systems requiring air filtration means.

Separator 23 is sandwiched between formed holder 24 and aerosol filter media 22. Screen 21 abuts against filter media layer 22. The outer dimensions of filter media layer 22 and screen 21 are slightly larger than that of separator 23. Filter media layer 22 and screen 21 are attached at their peripheral edges to holder 24, e.g. by heat sealing, with separator 23 being in a floating or unsecured condition relative to tubular portion 12 of hood mask 10 between layer 22 and holder 24, in a manner more particularly described below. In other words, flange member 25, screen 21, filter media layer 22 and formed holder 24 are heat sealed to the inside surface of tubular portion 12 of hood mask 10 at their outer edges. The layer including formed holder 24, hard shell 26 and filter media 27 is heat sealed to tubular portion 12 (with members 25, 21, 22 and 23 interposed therebetween) via sealing with the outer periphery of holder 24 to tubular portion 12. However, separator 23 is not heat sealed to tubular portion 12 but is in a floating or unsecured condition relative to tubular portion 12, as well as relative to the various layers of the filter assembly. By providing a separator 23 which is slightly smaller than holder 24, filter media layer 22 and screen 21 so that separator 23 is not heat sealed but in a floating condition relative to tubular portion 12, manufacture of the overall hood mask and filter assembly is facilitated.

Figure 3:
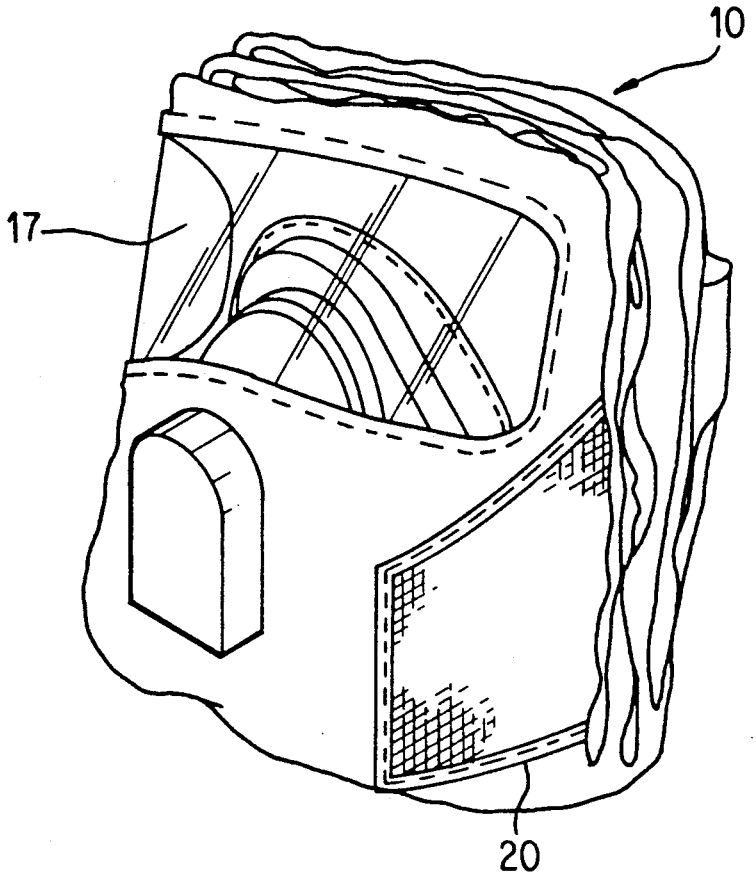
FIG. 3 shows the hood mask of FIG. 1 in a folded condition.

FIG. 3 shows the hood mask of FIG. 1 in a folded condition. Since annular member 28, formed holder 24, separator 23, aerosol filter media 22 and screen 21 are formed of relatively flexible materials, and since much smaller hard shell 26 holding the gas adsorbing or scrubbing material constitutes the only rigid member of the filter assembly, the flexible-rigid filter assembly of the invention enables the filter itself to be folded into a small space, thus enabling the overall hood mask assembly also to be folded into a small size as shown in FIG. 3. As indicated above, prior art hood mask designs heretofore enclosed the entire filter assembly in a hard canister, thus yielding a non-foldable filter.

Figure 4:
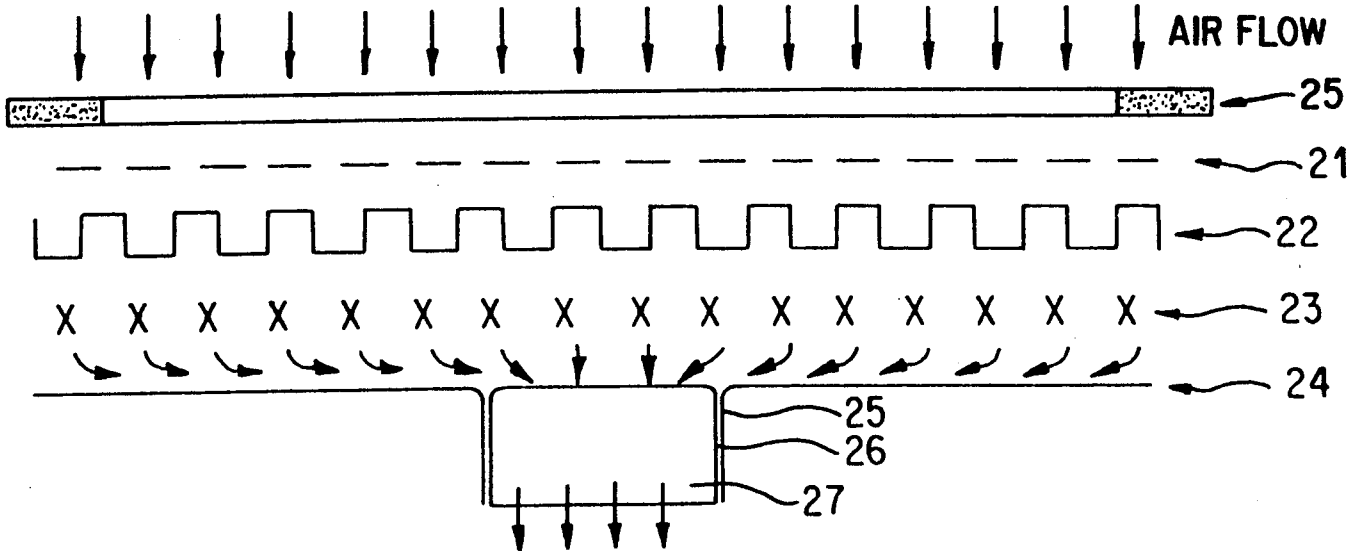
FIG. 4 is a schematic view showing the elements of a filter system according to the invention for integration with the hood mask of FIG. 1.

FIG. 4 schematically illustrates the elements of a filter system according to the invention. FIG. 4 shows the direction of air flow onto flange member 25, screen 21, aerosol filter media 22, separator-spacer 23, and formed holder 24 containing hard shell 26 and activated charcoal 27.

A method of forming a hood mask and filter assembly according to invention is as follows. With reference to FIG. 1, a first layer formed of aerosol filter media 22 and a second layer formed of flexible holder 24, rigid shell 26 and filter media 27 are positioned adjacent to one another and adjacent to tubular portion 12 such that the first layer is between the second layer and the tubular portion 12, and the first and second layers are heat sealed at their outer edges to the tubular portion 12. Opening 19 is preferably cut into tubular portion 12 after first and second layers are heat sealed to tubular portion 12, such that opening 19 substantially corresponds to the shape of both filter media 22 and filter media 27 to provide fluid communication between the ambient and the interior of the hood mask 10. Alternatively, opening 19 can be cut prior to heat sealing of the first and second filter assembly layers to tubular portion 12, with the filter assembly being positioned adjacent opening 19 such that the outer edges of the first and second filter assembly layers envelope opening 19. Additionally, a third layer comprising separator member 23 can be positioned between the first and second layers prior to the above heat sealing step, so that manufacture includes heat sealing the first layer and the second layer at their outer edges to the tubular portion with the third layer interposed between them in a floating condition relative to the tubular portion and relative to the first and second layers. Manufacture of the embodiment including flange member 25 involves interposing flange member 25 between the first filter layer and tubular portion 12, and then sealing flange member 25 and the first and second filter layers to the tubular portion preferably simultaneously in a continuous operation. Also, screen member 21 can be positioned between flange member 25 and filter media 22 with members 24, 21, 22 and 25 being simultaneously sealed to tubular portion 12 in a continuous operation. It should be noted that the members forming filter assembly 20 can alternatively be sealed to the tubular portion via sewing, adhesive bonding or other suitable attachment techniques.

Figure 2:
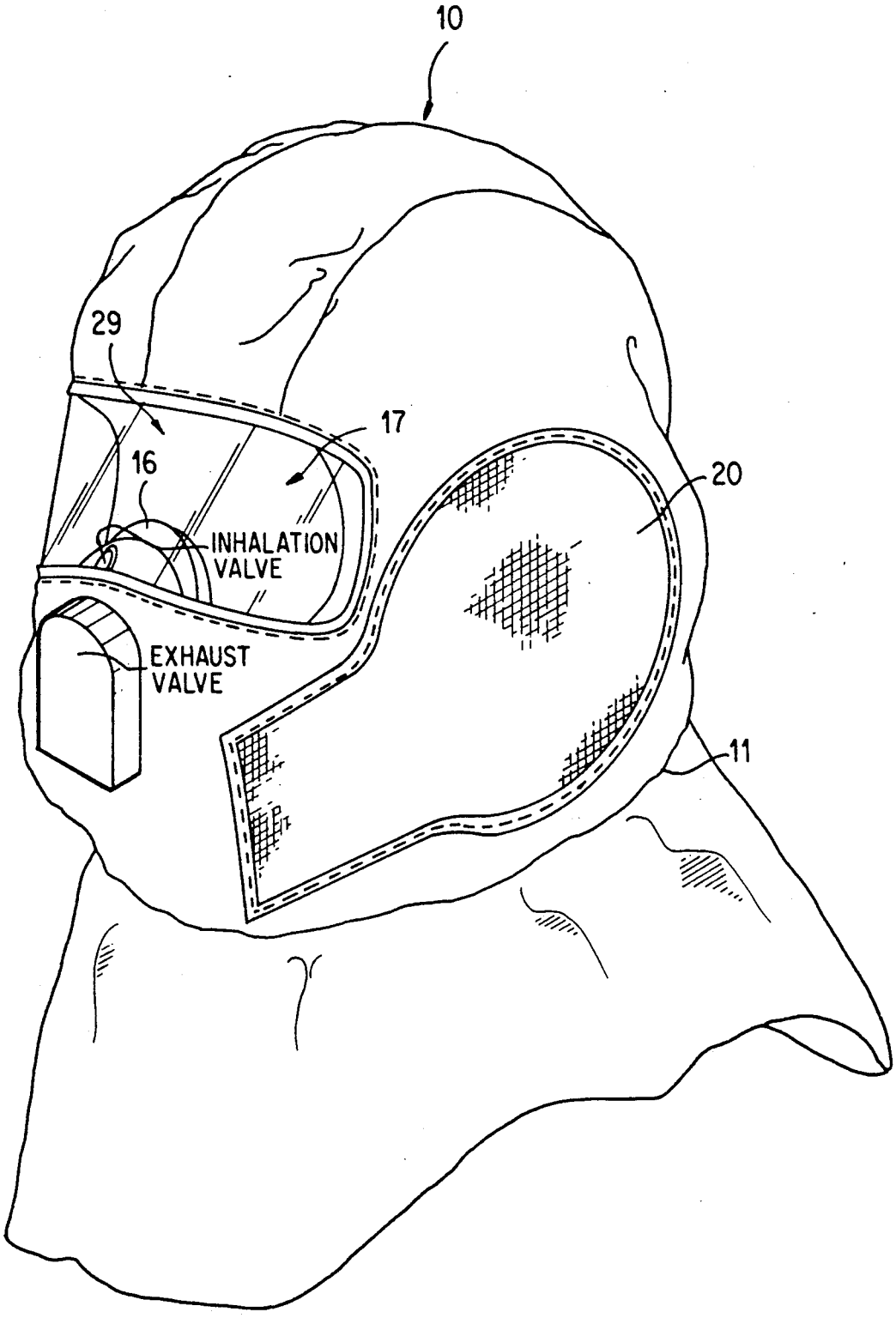
FIG. 2 is a side view of a hood mask according to the present invention.

It should be further noted that during assembly, tubular portion 12 is advantageously turned inside out prior to attachment of filter assembly 20 thereto and then after the attachment step, tubular portion 12 is turned right-side out so that filter assembly 20 is positioned inside hood mask 10. Member 28 thus abuts against the ear of the wearer, while synthetic fiber screen 21 is exposed to the ambient via opening 19 in tubular portion 12. As shown in FIG. 2, opening 19 is cut such that it corresponds to the shape of screen 21 exposed through the inside of flange member 25.

Additionally, the filter assembly can be manufactured as a separate unit prior to attachment to the hood mask or other system with which it is to be used. This can be accomplished by securing oblong annular member 28 to hard shell 26 which has gas adsorbing or scrubbing material 27 disposed therein, placing shell 26 into opening 255 in holder 24 and positioning separator 23, filter media layer 22 and screen 21 in layered fashion against the layer provided by holder 24, shell 26, annular member 28 and filter material 27. Screen 21, filter media layer 22, formed holder 24 and annular member 28 can then be sealed together, preferably by a heat sealing technique, in a continuous sealing operation to provide a unitary flexible-rigid filter assembly 20. Thereafter, assembly 20 can be attached to tubular portion 12 of hood mask 10 or a surface of any other system with which the filter assembly is to be used. It should be noted that the above-described manufacturing techniques provide a separator 23 in a floating or non-secured condition relative to other elements, in accordance with the description set forth above.

The above description and the accompanying drawings are merely illustrative of the application of the principles of the present invention and are not limiting. It should be noted that numerous other arrangements which embody the principles of the invention and which fall within its spirit and scope may be readily devised by those skilled in the art. Accordingly, the invention is not limited by the foregoing description, but the invention is defined by the scope of the appended claims.

We claim:

1. A hood mask for protecting the wearer from chemical and biological environmental contaminants, comprising:

a hood including a substantially tubular portion having a closed upper end, an open lower end, a side wall having inner and outer surfaces, and a sealing means attached to said tubular portion near said lower end to provide an air tight closure around the neck of the wearer; and an air filter means connected to said tubular portion for purifying air breathed into the interior of said hood by the wearer, said filter means comprising:

(a) a first layer formed of a first filter member composed of a foldable material;

(b) a second layer including a holder which supports a rigid housing member which houses a second filter member, said holder being formed of a flexible foldable material which has a throughbore in which said rigid member is disposed, said first layer and said holder being sealed to one another at their outer edges and having a larger surface area than the second filter member and the rigid housing member for the second filter member, so that the first filter member and the holder are foldable at least partially around the second filter member and said rigid housing member; and (c) a third layer comprising a separator member which has outer dimensions slightly smaller than those of said first layer and said holder and is interposed in a floating condition relative to said tubular portion between said first layer and said second layer; wherein said rigid member has the shape of a shell and is formed of sheet metal aluminum.

2. The hood mask as in claim 1, wherein said first layer and said holder are sealed at their outer edges to said tubular portion.

3. The hood mask as in claim 2, wherein said filter means further comprises a third layer comprising a screen member, said first layer being interposed between said third layer and said second layer, said third layer being sealed at its outer edges to said first layer, said holder, and said tubular portion.

4. The hood mask as in claim 3, wherein said screen member comprises a synthetic fiber screen structure.

5. The hood mask according to claim 3, wherein said first layer, said holder and said third layer are heat sealed at their outer edges to said tubular portion.

6. The hood mask as in claim 1, wherein said first filter member comprises an aerosol filter media and said second filter member comprises a gas adsorbing and scrubbing media.

7. The hood mask as in claim 6, wherein said aerosol filter media comprises a synthetic microfiber material.

8. The hood mask as in claim 6, wherein said aerosol filter media is permanently electrostatically charged.

9. The hood mask as in claim 1, wherein said holder is made of a polymeric material.

10. The hood mask as in claim 1, wherein said first layer and said holder are heat sealed at their outer edges to said tubular portion.

11. The hood mask as in claim 1, wherein said tubular portion further comprises a section formed of "spandex" material to provide a full head encapsulating retention mechanism.

12. An air filter assembly, comprising:

(a) a first layer formed of a first filter member composed of a foldable material;

(b) a second layer including a holder which supports a rigid housing member which houses a second filter member, said holder being formed of a flexible foldable material which has a throughbore in which said rigid member is disposed, said first layer and said holder being sealed to one another at their outer edges, and having a larger surface area than the second filter member and the rigid housing member for the second filter member, so that the first filter member and the holder are foldable at least partially around the second filter member and said rigid housing member; and (c) a third layer comprising a separator member which has outer dimensions slightly smaller than those of said first layer and said holder and is interposed in a floating condition between said first layer and said second layer; wherein said rigid member has the shape of a shell and is formed of sheet metal aluminum.

13. The air filter assembly as in claim 12, wherein said first layer and said holder are heat sealed to one another at said outer edges.

14. The air filter assembly as in claim 13, further comprising a third layer comprising a screen member, said first layer being interposed between said third layer and said second layer, said third layer being heat sealed at its outer edges to said outer edges of said first layer and said holder.

15. The air filter assembly as in claim 14, wherein said screen member comprises a synthetic fiber screen structure.

16. The air filter assembly as in claim 13, wherein said first filter member comprises an aerosol filter media and said second filter member comprises a gas adsorbing and scrubbing media.

17. The air filter assembly as in claim 16, wherein said aerosol filter media comprises a synthetic microfiber material.

18. The air filter assembly as in claim 16, wherein said aerosol filter media is permanently electrostatically charged.

19. The air filter assembly as in claim 13, wherein said holder is made of a polymeric material.

20. A method of manufacturing a hood mask comprising the steps of providing a hood including a substantially tubular portion having a closed upper end, an open lower end and a continuous side wall having inner and outer surfaces; connecting an air filter means to said tubular portion for purifying air breathed into the interior of the hood by the wearer; providing the filter means with a first layer formed of a first filter member and a second layer including a rigid member of sheet metal aluminum which houses a second filter member; forming said holder of a flexible foldable material; providing a throughbore in said holder in which said rigid member is disposed;

positioning said first and said second layer adjacent to one another and adjacent to said tubular portion such that said first layer is interposed between said second layer and said tubular portion;

positioning a third layer comprising a separator member which has outer dimensions slightly smaller than those of said first layer and said holder between said first layer and said second layer; and sealing the first layer and the second layer at their outer edges to said tubular portion with said third layer interposed between them in a floating condition relative to said tubular portion.

21. A hood mask for protecting the wearer from chemical and biological environmental contaminants, comprising:

a hood including a substantially tubular portion having a closed upper end, an open lower end, a side wall having inner and outer surfaces, and a sealing means attached to said tubular portion near said lower end to provide an air tight closure around the neck of the wearer; and an air filter means connected to said tubular portion for purifying air breathed into the interior of said hood by the wearer, said filter means comprising:

(a) a filter layer formed of a first filter member composed of a foldable material;

(b) a second layer including a holder which supports a rigid housing member which houses a second filter member, said holder being formed of a flexible foldable material which has a throughbore in which said rigid member is disposed, said first layer and said holder being sealed to one another at their outer edges and having a larger surface area than the second filter member and the rigid housing member for the second filter member, so that the first filter member and the holder are foldable at least partially around the second filter member and said rigid housing member; and (c) a third layer comprising a separator member which has outer dimensions slightly smaller than those of said first layer and said holder and is interposed in a floating condition relative to said tubular portion between said first layer and said second layer; wherein said rigid member has the shape of a shell and is formed of hard plastic.

22. The hood mask as in claim 21, wherein said first layer and said holder are sealed at their outer edges to said tubular portion.

23. The hood mask as in claim 22, wherein said filter means further comprises a third layer comprising a screen member, said first layer being interposed between said third layer and said second layer, said third layer being sealed at its outer edges to said first layer, said holder, and said tubular portion.

24. The hood mask as in claim 23, wherein said screen member comprises a synthetic fiber screen structure.

25. The hood mask according to claim 23, wherein said first layer, said holder and said third layer are heat sealed at their outer edges to said tubular portion.

26. The hood mask as in claim 21, wherein said first filter member comprises an aerosol filter media and said second filter member comprises a gas adsorbing and scrubbing media.

27. The hood mask as in claim 26, wherein said aerosol filter media comprises a synthetic microfiber material.

28. The hood mask as in claim 26, wherein said aerosol filter media is permanently electrostatically charged.

29. The hood mask as in claim 21, wherein said holder is made of a polymeric material.

30. The hood mask as in claim 21, wherein said first layer and said holder are heat sealed at their outer edges to said tubular portion.

31. The hood mask as in claim 21, wherein said tubular portion further comprises a section formed of "SPANDEX" material to provide a full head encapsulating retention mechanism.

32. An air filter assembly, comprising:

(a) a first layer formed of a first filter member composed of a foldable material;

(b) a second layer including a holder which supports a rigid housing member which houses a second filter member, said holder being formed of a flexible foldable material which has a throughbore in which said rigid member is disposed, said first layer and said holder being sealed to one another at their outer edges and having a larger surface area than the second filter member and the rigid housing member for the second filter member, so that the first filter member and the holder are foldable at least partially around the second filter member and said rigid housing member; and (c) a third layer comprising a separator member which has outer dimensions slightly smaller than those of said first layer and said holder and is interposed in a floating condition relative to said tubular portion between said first layer and said second layer; wherein said rigid member has the shape of a shell and is formed of hard plastic.

33. The air filter assembly as in claim 32, wherein said first layer and said holder are heat sealed to one another at said outer edges.

34. The air filter assembly as in claim 33, further comprising a third layer comprising a screen member, said first layer being interposed between said third layer and said second layer, said third layer being heat sealed at its outer edges to said first layer and said holder.

35. The air filter assembly as in claim 34, wherein said screen member comprises a synthetic fiber screen structure.

36. The air filter assembly as in claim 33, wherein said first filter member comprises an aerosol filter media and said second filter member comprises a gas adsorbing and scrubbing media.

37. The air filter assembly as in claim 36, wherein said aerosol filter media comprises a synthetic microfiber material.

38. The air filter assembly as in claim 36, wherein said air filter media is permanently electrostatically charged.

39. The air filter assembly as in claim 33, wherein said holder is made of polymeric material.

40. A method of manufacturing a hood mask comprising the steps of providing a hood including a substantially tubular portion having a closed upper end, an open lower end and a continuous side wall having inner and outer surfaces; connecting an air filter means to said tubular portion for purifying air breathed into the interior of the hood by the wearer; providing the filter means with a first layer formed of a first filter member and a second layer including a rigid member of hard plastic which houses a second filter member; forming said holder of a flexible foldable material; providing a throughbore in said holder in which said rigid member is disposed; positioning said first and said second layer adjacent to one another and adjacent to said tubular portion such that said first layer is interposed between said second layer and said tubular portion; positioning a third layer comprising a separator member which has outer dimensions slightly smaller than those of said first layer and said holder between said first layer and said second layer; and sealing the first layer and the second layer at their outer edges to said tubular portion with said third layer interposed between them in a floating condition relative to said tubular portion.

* * * * *